United States Patent [19]

Harlegard

[11] Patent Number: 4,670,061

[45] Date of Patent: Jun. 2, 1987

[54] PROCESS FOR IMPROVING THE AUTOMATIC EMPTYING AND CLEANING OF HYGIENIC VESSELS UNDER OPTIMUM INFEED OF RINSING WATER AT MINIMAL WATER USAGE AND ARRANGEMENT FOR IMPLEMENTING THE PROCESS

[75] Inventor: Jan Harlegard, Therwil, Switzerland

[73] Assignee: SIC AG, Switzerland

[21] Appl. No.: 646,643

[22] Filed: Aug. 31, 1984

[51] Int. Cl.[4] ..... B08B 7/04

[52] U.S. Cl. ..... 134/18; 134/25.1; 134/25.4; 134/22.18; 422/28; 422/101; 422/302; 422/308

[58] Field of Search ..... 134/18, 22.1, 22.12, 134/25.1, 25.4, 22.18, 25.5, 52, 53, 95, 99, 153, 57 R; 422/28, 302, 304, 101

[56] References Cited

U.S. PATENT DOCUMENTS

| | | | |
|---|---|---|---|
| 3,357,440 | 12/1967 | Bianchi | 134/153 |
| 3,645,283 | 2/1972 | Cassells | 134/95 |
| 3,645,791 | 2/1972 | Sadwith | 134/153 |
| 4,237,912 | 12/1980 | Hillefal | 134/95 |
| 4,296,068 | 10/1981 | Floshino | 422/304 |

*Primary Examiner*—Andrew H. Metz
*Assistant Examiner*—Sharon T. Cohen
*Attorney, Agent, or Firm*—Scully, Scott, Murphy & Presser

[57] ABSTRACT

A process and for improving the automatic emptying and cleaning of hygienic vessels or receptacle under conditions providing for the optimum infeed of rinsing water and for a minimal water usage.

13 Claims, 11 Drawing Figures

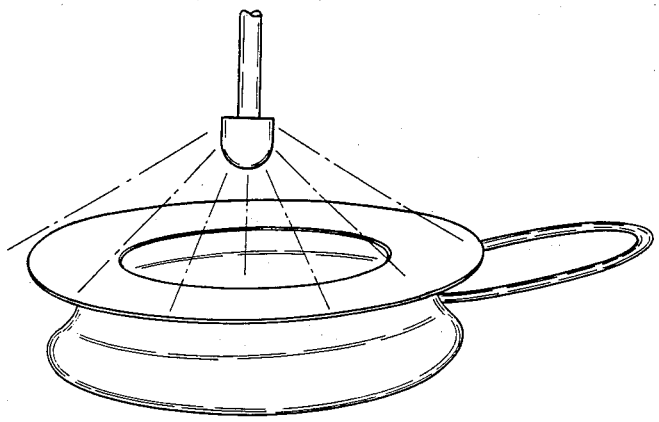
FIG.4.1
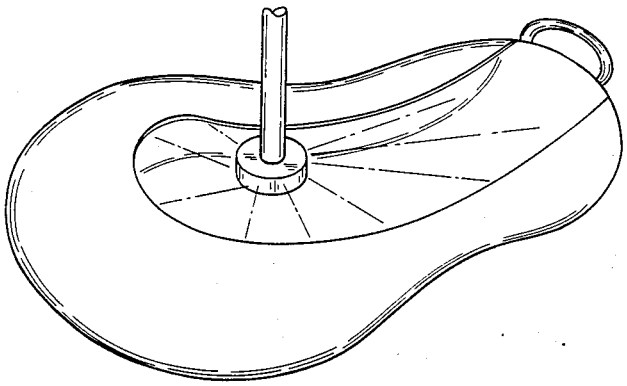
FIG.4.2
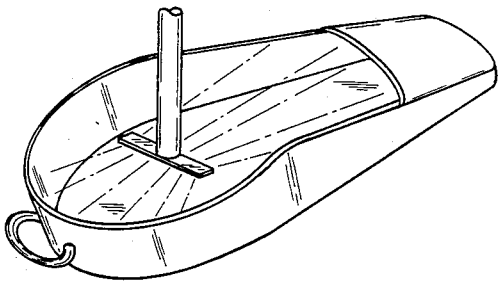
FIG.4.3

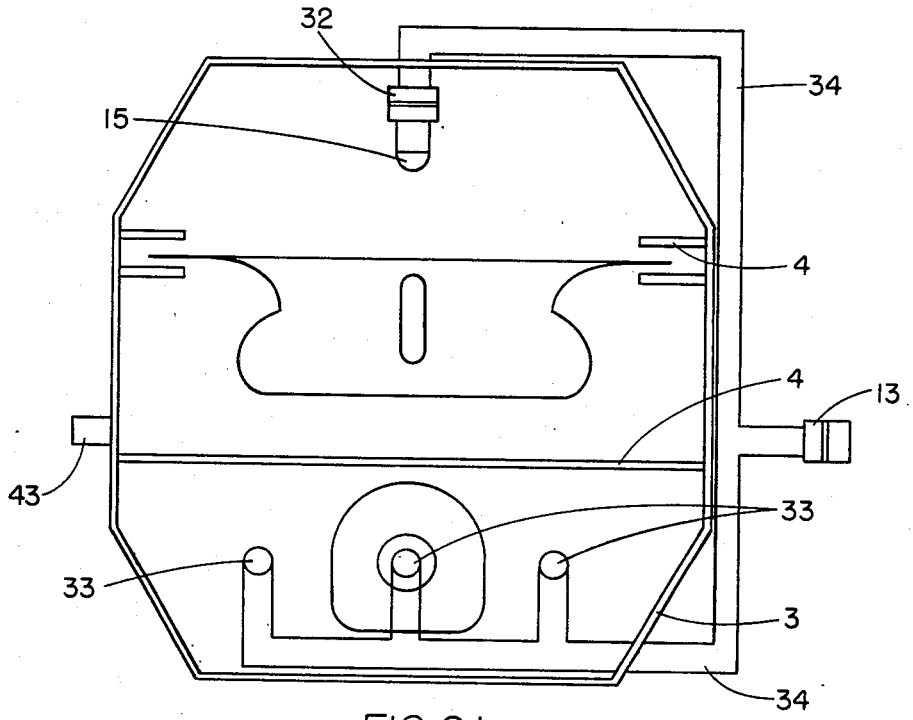
FIG.6.1
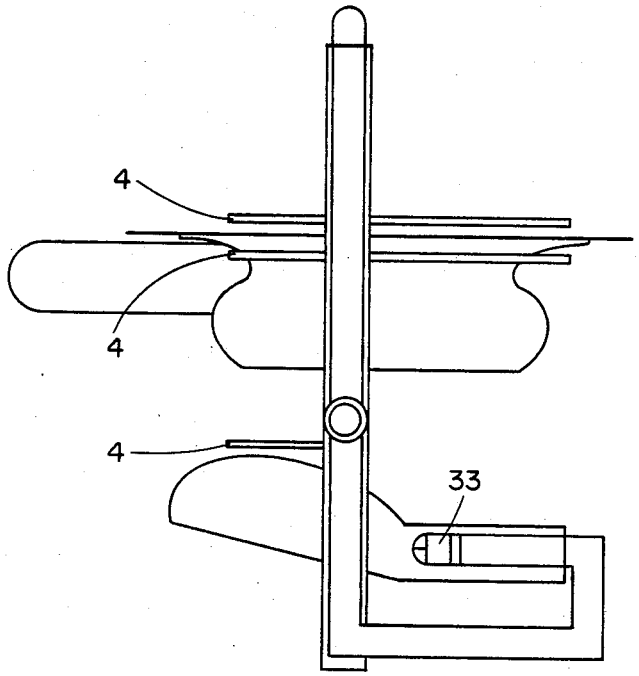
FIG.6.2

PROCESS FOR IMPROVING THE AUTOMATIC EMPTYING AND CLEANING OF HYGIENIC VESSELS UNDER OPTIMUM INFEED OF RINSING WATER AT MINIMAL WATER USAGE AND ARRANGEMENT FOR IMPLEMENTING THE PROCESS

BACKGROUND OF THE INVENTION

1. Field of the Invention

The present invention relates to a process for improving the automatic emptying and cleaning of hygienic vessels or receptacle under conditions providing for the optimum infeed of rinsing water and for a minimal water usage. Furthermore, the invention also relates to an arrangement for implementing the process.

2. Discussion of the Prior Art

German Published patent application No. 32 09 305 discloses a process for the automatic emptying and cleaning of hygienic receptacles under an optimum infeed of rinsing water at minimum water usage, and well as an arrangement for implementing the process disclosed therein.

In essence, the prior art process disclosed in the German OS contemplates the introduction of a contaminated receptacle into a rinsing chamber, including closing of the door of the chamber without contact while providing for the concurrent sealing thereof, emptying the receptacle through rotation thereof by a rotating arrangement operating in synchronism with the closing of the chamber door, cleaning the internal space thereof, subsequent to effecting the emptying, with pressurized water through a rotary nozzle while wetting the inner surface of the rinsing chamber and the outer surface of the receptacle, and removing the cleaning water. Thereafter, the rotary nozzle is switched off, another flow conduit is opened which is connected with the rotary arrangement and complete internal cleaning is effected with pressurized water under an elevated flow pressure, and then the removal of the cleaning water through a syphon. Thereafter, the door is opened, with concurrent rotation of the receptacle in the reverse direction and withdrawal of the cleaned receptacle.

Thereafter, there is carried out a repetition of the above process steps for the periodic, automatic emptying and cleaning, control of the sequence of the process steps through a programmed control and motorized drive. The prior art arrangement as disclosed in German OS No. 32 09 305 consists of a rinsing chamber which includes, on one side, thereof a closable opening which can be sealed through a sliding door, and which includes a rotating arrangement movable about a horizontal pivot axis with a holder support which serves for the holding and tilting of a hygienic receptacle and which, through a motor and a lower reversing roller implements the moving sequences of the sliding door, and by means of a gear effects the rotation of the rotating arrangement with the holder support, which at an inner cover incorporates a spherical nozzle or a rotary nozzle which is supplied with cleaning water from a water supply through a flow conduit through a pump. With respect to the particular structure of the German OS No. 32 09 305, the arrangement disclosed therein also discloses that, in lieu of the rotary arrangement, there can be employed an exchangeable insert basket for the hygienic receptacles which are to be introduced therein, and wherein the flow conduit connecting with the rinsing chamber can have spray water introduced into the chamber through one or more upwardly directed spray nozzles for the cleaning of hygienic receptacles which are inserted therein with downwardly facing openings.

The arrangement and process pursuant to the prior art device disclosed in the German patent application has the disadvantage that it is not possible to implement a concurrent emptying, cleaning and disinfection for receptacles, such as bedpans and urine flasks, and in which the urine flasks must be inserted with downwardly facing openings. Consequently, it is not possible to avoid the premature outflow of dirt particles or contaminants. Consequently, at least two arrangements are required adjacent each other for use in the cleaning of bedpans or for urine flasks. Consequently, this requires a higher amount of financial investment and a high water use. In order to avoid such disadvantages, it would be necessary to provide for an intermediate stacking of the bed pans or the urine flasks in order to be able to clean either one or the other type of vessels. Consequently, this procedure entails considerable losses in time required for the exchange of rotary arrangement or the insert basket, which thereby reduces the capacity of the arrangement.

Furthermore, the prior art arrangement also entails disadvantages encountered during the operating cycle and in the hygienic operation which are considered to be undesirable.

SUMMARY OF THE INVENTION

Accordingly, it is an object of the present invention to provide a process and an arrangement which avoids the disadvantages encountered in the prior art, and which will improve upon the automatic emptying and cleaning of hygienic vessels or receptacles under optimum infeed of the rinsing water and at minimum water use.

In accordance with the present invention the process has as its object that, in conjunction with the implementation of the process, there is achieved an improved implementation of a simplified constructive installation. Achieved is an improved operational reliability and there is also attained a reduced investment cost.

Furthermore, it is an object of the present invention to provide a process for the automatic emptying and cleaning of hygienic vessels or receptacles without any contamination of the external arrangement, which introduces the rinsing water and the cleaning water in an optimum manner through correlation with the shapes used types of the hygienic vessels and, namely, at minimum water usage.

In order to attain the object of the foregoing invention, pursuant to the inventive process there are implemented the following process steps, the combination of which provides the improvement:

1. Introduction of the filled contaminated hygienic vessel into the holding support of the rotary arrangement within the interior space of a rinsing chamber of the arrangement;

2. Closing of a gate or sliding door which is lowered from above in a vertical motion at the front side of the rinsing chamber through pushbutton pressure without touching by hand, and with the concurrent sealing of the rinsing chamber relative to the exterior and with the simultaneous emptying of the vessel into a lower conical portion of the rinsing chamber above a closure syphon through motorized rotation of the rotating arrangement operating in synchronism with the closing of the sliding door such rotation being effected in that the axis extending perpendicular to the center of the cross-section of the hygienic vessel, after completion of the rotating cycle, forms a downward angle by the mouth of the vessel of over 90° to up to about 140°;

3. Cleaning the interior space of the rinsing chamber of the arrangement after completion of the closing sequence of the door and after the emptying of the vessel with pressurized water through a rotary nozzle which is located on the ceiling of the rinsing chamber, and in such a manner that all interior surfaces of the rinsing chamber, as well as all outer surfaces of the hygienic vessel are, for a short period, practically fully wetted and cleaned, and wherein the cleaning water will completely remove the vessel content through the syphon at the lower conical portion of the rinsing chamber;

4. Switching off of the rotary nozzle, opening a flow conduit extending through the outer chamber wall of the rinsing chamber, which conduit by means of a rotary coupling in the interior space of the rinsing chamber is connected with another flow conduit which is fixedly interchangeably connected with the rotating arrangement, and wherein the pressurized water, through a nozzle which is located to some extent above the center of the opening of the vessel, is introduced into this nozzle for the complete internal cleaning under an increased flow pressure in comparison with the pressure of the rotary nozzle in process Step 3, and wherein the cleaning water is completely removed through the syphon in the lower conical portion of the rinsing chamber;

5. Opening of the sliding door upwardly, with the concurrent rotation of the holder support in the rotating arrangement in a reverse direction of rotation relative to the rotation in process Step 2; and removing the emptied and cleaned vessel;

6. Repeating process Steps 1 to 5 for the periodic automatic emptying and cleaning of hygienic vessels;

7. Controlling the sequence of the process steps through a programmed control and motorized drive of the motion sequences in the process steps.

The process pursuant to the invention affords the advantage in comparison the state of the art, in that there is hereby avoided the need for a large number of conduits and nozzles which can have a tendency towards encrustation. For the cleaning for the large number of nozzle, in order to avoid encrustation, there is required a significant technological demand. This is clearly avoided with the relatively few nozzles necessitated by the inventive process and the inventive arrangement.

The inventive process affords the further technological advantage that, through the correlation in the spacing of the nozzle relative to the rotating arrangement towards the bottom of the hygienic vessel, and simple exchange of the rotating arrangement with conduit nozzle, it is possible to afford the optimum cleaning with a minimal water quantity.

Also the selection of the shape of the nozzles for the flexible correlation to the different shapes of the hygienic receptacles or vessels constitutes a significant advantage for the scope of application of the process of the invention in conjunction with the arrangement for its implementation. Furthermore, the arrangement for implementing the inventive process also provides the advantage of a small spatial requirement, and the possibility of connections to already installed water supply conduits and discharge lines, as well for connection to an available electrical power supply.

The process of the invention in conjunction with the arrangement for its utilization also provides a significant sanitary advantage since through the automation of the emptying and the cleaning of the contaminated hygienic vessels of all kinds of types without any contamination of the external structure and without contacting of the contaminants by the operating personnel, there can be securely and rapidly effected the manipulation with reduced operational demands.

The foregoing inventive process in conjunction with the arrangement for its implementation provides for invention which, in a surprising manner, fulfills the advantages and economic requirements for the sanitary care of the population in a clinical and sterilized context.

The process also affords, in a preferred embodiment thereof, assurance that upon interruption of the hot water conduit in the case of failure, in an exposed air distance in an upper water container there cannot occur any suctioning back of steam or water. Any egress of steam or water is effected within the water container. This preferred embodiment of the process affords the further advantage that any water losses can be internally contained without further requirements.

The inventive process also affords the combined and simultaneous emptying and cleaning of bedpans and urine flasks within the same operative cycle. Consequently, the constructive arrangement of the rotating holding support provides the possibility of the horizontal introduction of urine flasks and their automatic emptying through their rotation.

Through the concurrent emptying and cleaning of bed pans and urine flasks which are located adjacent each other together with their contents, it is possible to provide a continuous operating sequence which leads to an increase in the throughput capacity and to an improvement in hygiene. Moreover, the overall use of water and, thereby, also the energy requirement, is considerably reduced during the operating cycle.

In order to achieve the foregoing object and for an improvement over the known process and the arrangement pursuant to the state of the art, in actual practice there is also encountered a requirement for the automatic emptying and cleaning of flasks, such as urine flasks or secretion receptacles or other vessels with contaminants, which are included into the process pursuant to the invention. Accordingly, the process of the invention has set the object that, for the implementation these operative sequences, these be carried out by a rotatable arrangement with supports for an insert basket which, prior to its insertion into this rotary support, can be filled with upright urine flasks. Thus, it is possible to provide a stacking of the flasks in cages provided in the insert basket.

The process pursuant to the invention affords, in a simple manner, the insertion and the withdrawal of the insert basket into or, respectively, from the rotatable support into the rinsing chamber of the apparatus.

The flasks which are to be cleaned are placed vertically upright into the adjacent located cages, which represent individual boxes of wire mesh. These flasks are then optimally, and over a short time period, emptied and cleaned during the rotation of the rotary support by means of nozzles which are introduced into their mouths or openings, and which nozzles are arranged below a basket cover. Avoided thereby, through the vertical placement of the flasks into the cage of the insert basket, is the previously encountered spilling out of their contents.

The introduction of the cleaning water during the rotation of the rotary support is optimal since the pressure nozzle is always at the same distance in the vessel mouth opening. Hereby, the water requirement for the cleaning of the urine flasks is also retained low. Due to the close spacing of the spray nozzle to the inner surface of the flasks there will be achieved a complete and intensive spraying of their inner surfaces. The time period for this effect can be set through the rotating period of the rotatable support.

The capability of utilization of the same apparatus with a rotatable support for the insertion of hygienic vessels concurrently with urine flasks located an insert basket for the flasks, affords a correlation with the presently encountered requirements. The exchangeable, movable rotary support, or the uncoupling of a flexible pressure hose for the water supply, is effected in the arrangements for implementing the process of the invention in a rapid and assured manner. This development also represents a simplification with respect to the mode of operation pursuant to the current state of the art.

BRIEF DESCRIPTION OF THE DRAWINGS

Reference may now be had to the following detailed description of preferred embodiments of the invention, illustrative of an arrangement for the automatic emptying and cleaning of hygienic vessels under optimum infeed of rinsing water at minimal water usage, taken in conjunction with the accompanying drawings; in which:

FIGS. 4.1 through 4.3 illustrate various embodiments of bedpans, whose optimal cleaning is rendered possible with a minimal water quantity;

FIG. 6 illustrates a particular configuration of the rotary support shown, respectively, in a front and side elevational view;

DETAILED DESCRIPTION

Figure 1:
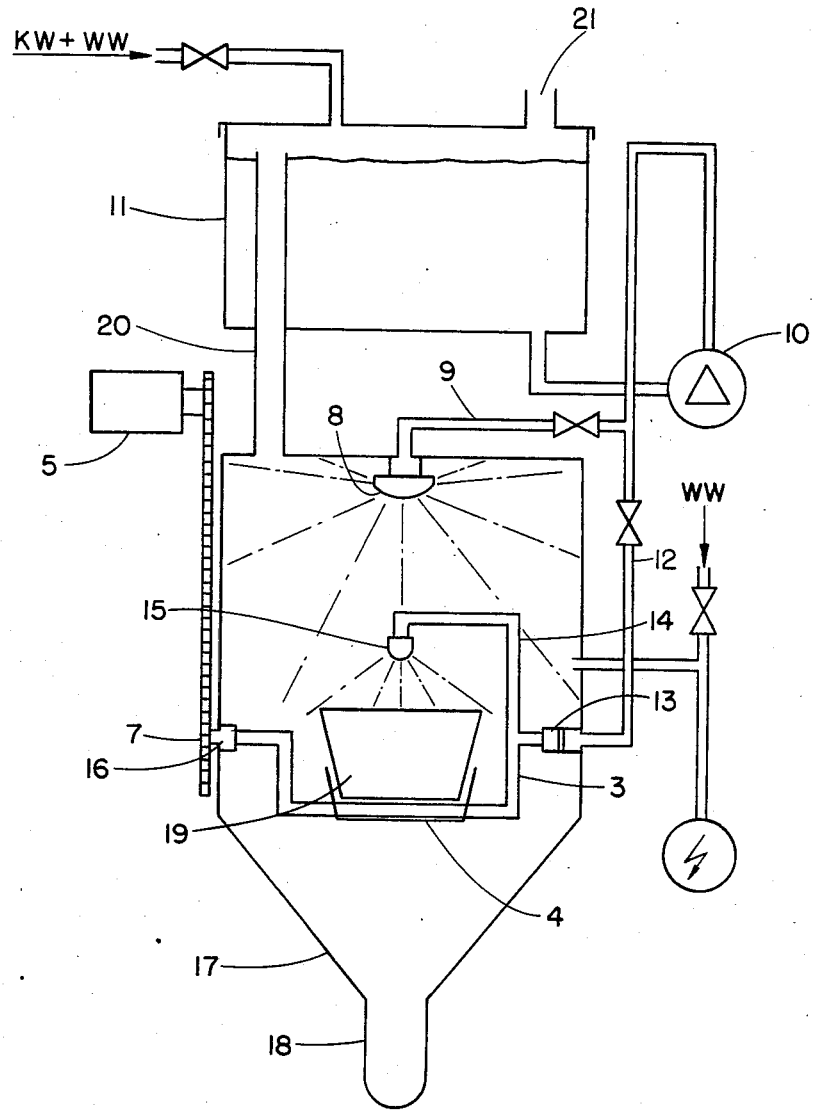
FIG. 1 schematically illustrates a front elevational view of the inventive arrangement, with the open sliding door shown removed for purposes of clarity.
Figure 2:
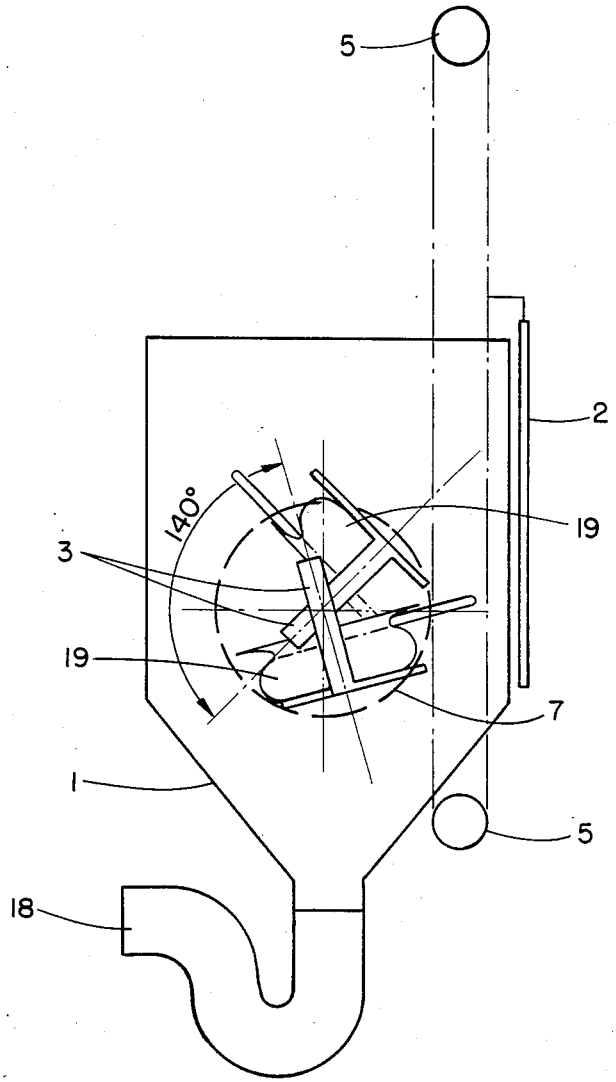
FIG. 2 illustrates a side elevational view thereof with the sliding door closed, also representing the rotational movement of the rotating arrangement for the hygienic vessel both prior and subsequent to the emptying thereof.

Referring now in detail to the drawings, and in particular FIGS. 1 and 2, there is illustrated a rinsing chamber 1 with a conical lower portion, which incorporates a vertical sliding door 2, having particular reference to FIG. 2 of the drawings.

A rotating device 3 for hygienic vessels 19 incorporates a motor 5 for effectuating the rotary movements, and also includes a reversing roller 6 for the drive, and a drive gear 7 for the rotating device 3.

There is also provided a rotary nozzle 8 for the cleaning of the interior space of the hygienic vessel 19.

A flow conduit 9 for cleaning water communicates with the nozzle 8 and, in turn, is connected to a water pump 10 and to a water container 11 arranged above the rinsing chamber. A flow conduit 12 for water connects to the rotating device 3, and incorporates a rotary coupling 13 and a flow conduit 14 for water leading to the nozzle on the rotating device. The nozzle on the rotating device 3 is designated by reference numeral 15.

A support 16 is provided for a holder device for the hygienic vessel.

The rinsing chamber 1 includes a lower conical discharge section 17 which connects at its lower end with a syphon 18 for the closing off of the rinsing chamber.

At the upper end of the rinsing chamber there is connected an overflow and condensation tube 20 leading to the water container 11 which, in turn, is provided with a vent opening 21.

Figure 3:
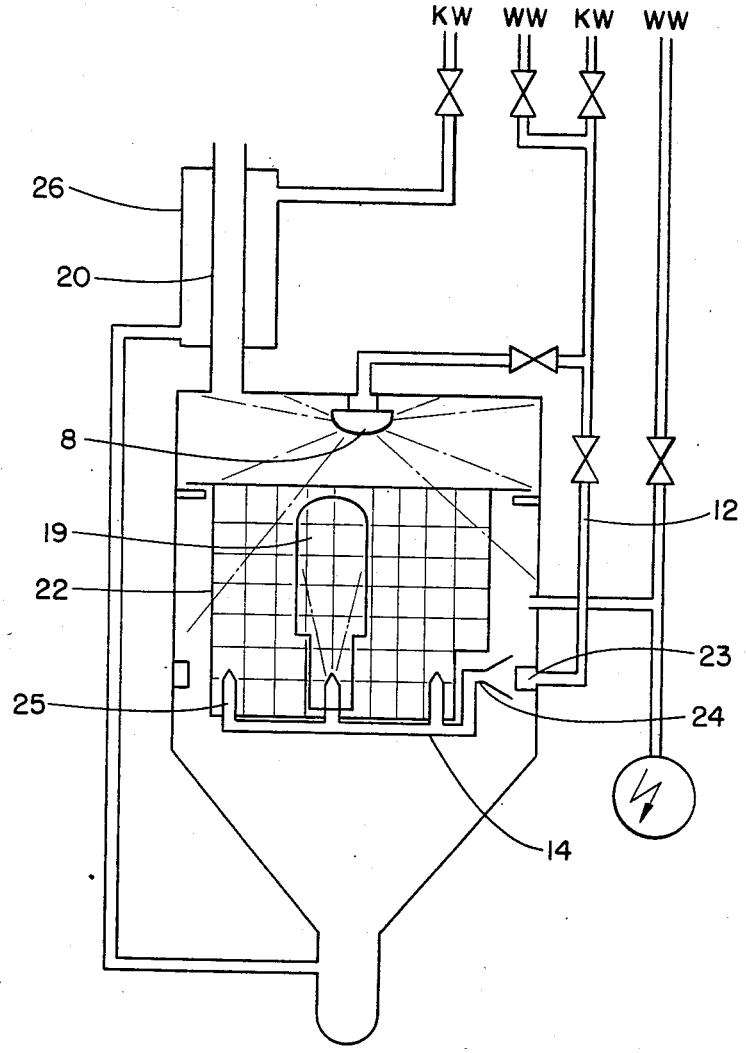
FIG. 3 illustrates a further embodiment of the inventive arrangement with the utilization of a non-rotatable exchangeable insert basket in lieu of the rotating arrangement for the insertion of flasks having downwardly oriented openings.

The hygienic receptacle or vessel 19, as shown more specifically in FIG. 3 of the drawings, may be arranged in an insert basket 22. In this instance, in lieu of the rotary coupling of the previous embodiment, there is provided a nozzle 23 leading to a receiving funnel 24 for spray water. Arranged in the insert basket are spray nozzles 25 for the hygienic vessels 19, which are shown oriented with downwardly facing mouth openings.

A cooling jacket 26 for heated steam is provided in the overflow and condensation tube 20 which leads to the water container 11.

Referring to FIGS. 4.1, 4.2 and 4.3 of the drawing there are illustrated three different types of hygienic vessels, generally in the configuration of bedpans, wherein the interiors thereof are adapted to be sprayed with cleaning water through suitable spray nozzles, as illustrated. In the embodiment of FIG. 4.1 the hygienic vessel is a generally round bed pan; in the embodiment of FIG. 4.2 the bedpan is of generally reniform configuration; and in the embodiment of FIG. 4.3 the hygienic vessel is a bedpan of generally pie-shaped configuration.

Figure 5:
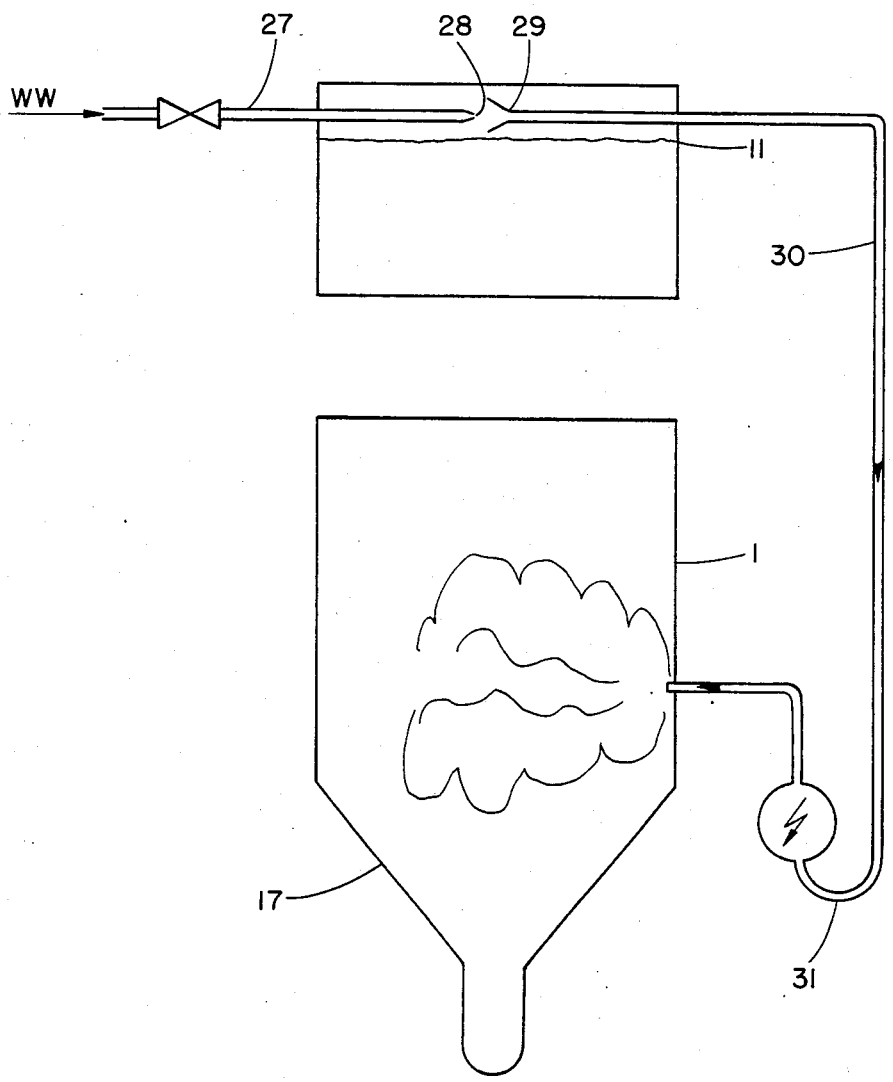
FIG. 5 illustrates the structure for the condensation of the hot steam for alternative disinfection through steam spraying, and also illustrates the features for the condensation of the hot steam through cooling.

As illustrated in FIG. 5 of the drawings, in conjunction with FIGS. 1, 2 and 3, there is disclosed a flow conduit 27 for the infeed of water to the water container 11, which with an open distance 28, faces a funnel-shaped widening 29 of a water outlet flow conduit 30. The lower end of the water outlet conduit 30 connecting into a U-shaped extension 31 communicating with the rinsing chamber 1 for the introduction of hot steam therein. A suitable heating coil or steam generator may be provided towards the outlet end of the U-shaped conduit section 31. FIG. 6 illustrates a particular configuration of the rotating support for the hygienic vessel which includes a coupling member 32 communicating with nozzles 33 through a flow conduit 34, and with an insert connection 43 communicating with the arrangement, which includes the rotary coupling 13 of the rotary device 3 for the hygienic vessels.

Figure 7:
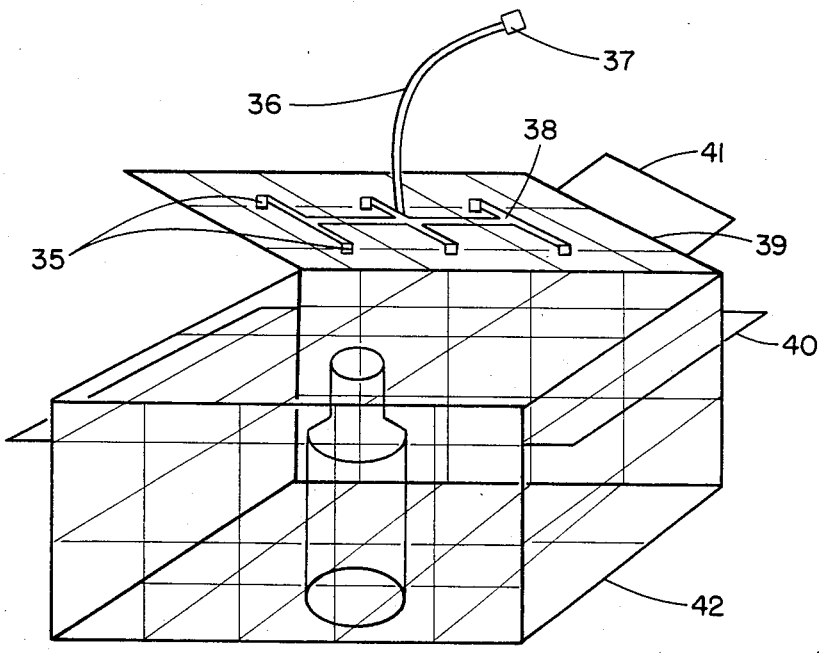
FIG. 7 illustrates an insert basket positioned in the rotary support with filled flasks, shown in a perspective view.

FIG. 7 of the drawing illustrates, in a perspective view, an insert basket 42 adapted to be introduced into the rinsing chamber 3, wherein the insert basket is provided with nozzles 35 connected to water distributing conduit 38, and adapted to be supplied with water through a pressure hose 36. The free end of the pressure hose 36 communicates with a coupling member leading to a source of supply for water (not shown). The arrangement for the nozzles is mounted in the cover 39 of the insert basket 42, which incorporates elbows 41 in the cover portion thereof.

Insert rails 40 extend from opposite sides of the insert basket 42 which communicate with the insert connection 43, as illustrated in FIG. 6 of the drawings. In this arrangement, as illustrated in FIG. 7, in lieu of a bed pan there may be employed a preferred form of a hygienic vessel which has a metal cuff about its opening. In this preferred form of the receptacle, the hygienic vessel is fastened in a downwardly directed holding arm 35. The emptying is effected in the same manner as that for the bed pan, as is the cleaning by pressurized water from the nozzle 15, as is illustrated in FIG. 8 of the drawings.

Figure 8:
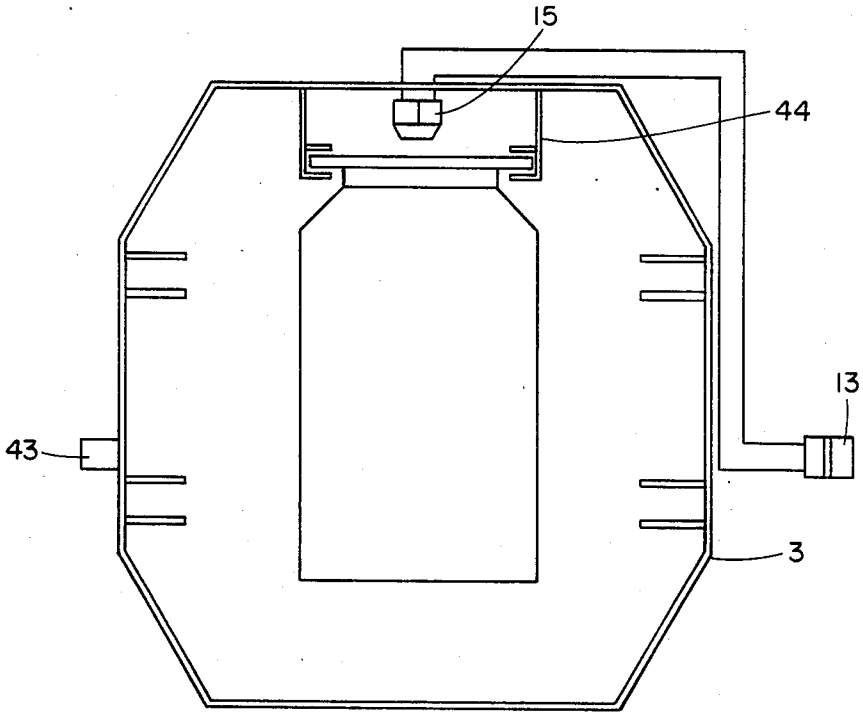
FIG. 8 illustrates the insertion of a secretion flask into a holding arm located below the upper surface of the rotating arrangement.

More specifically, FIG. 8 illustrates the introduction of a secretion flask into the retaining or holder arm 44 which is located below the upper surface of the rotating device 3. The secretion flask is emptied, through the rotation of the rotating device 3, into the rinsing chamber 1, and is then cleansed by means of the cleaning nozzle 15 which is located above the center of the mouth opening of the secretion flask. This alternative construction of the rotating device 3 affords the advantage that the secreting flasks need not be emptied externally of the rinsing chamber 1; and within the closed rinsing chamber there is simultaneously effected the emptying and the cleaning of the secreting flask, and thereafter, the disinfection of the rinsing chamber.

From the foregoing there clearly appears that there is provided an improved and novel process and arrangements for the automatic emptying and cleaning of hygienic receptacles or vessels under optimum infeed of rinsing water and at minimum water usage.

While there has been shown and described what are considered to be preferred embodiments of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. A process for the automatic emptying and cleaning of hygienic vessels under optimum infeed of rinsing water at a minimum water use, comprising the following process steps:

(1) inserting filled, contaminated hygienic vessels into a fastening holder of a rotary arrangement internally of a rinsing chamber of a cleaning arrangement;

(2) closing a vertically downwardly movable sliding door on the front side of the rinsing chamber through pushbutton pressure without manual contact and effecting the concurrent sealing of the rinsing chamber with respect to the exterior, and simultaneously emptying the vessel into a lower conical portion of the rinsing chamber through a closure syphon by motorized rotation of a rotating means in synchronism with the closing of the sliding door, and effecting a rotation wherein the axis perpendicular to the center of the cross-section of the hygienic vessel, after completion of the turning cycle, forms an angle with the opening of the vessel downwardly of 90° up to about 140°;

(3) cleaning the interior space of the rinsing chamber of the arrangement after completion of the closing sequence of the door and after emptying of the vessel with pressurized water through a rotary nozzle located on the cover of the rinsing chamber such that all internal surfaces of the rinsing chamber, as well as all external surfaces of the hygienic vessel are wetted practically completely over a short period and are cleaned, and in which the cleaning water completely removes the vessel contents through the syphon in the lower conical portion of the rinsing chamber;

(4) deactivating the rotary nozzle, opening a flow conduit extending through the outer chamber wall of the rinsing chamber which, through a rotary coupling is connected with a further flow conduit interiorly of the rinsing chamber, and which is fixedly and exchangeably connected with rotary means for turning the vessels, and introducing the pressurized water through a nozzle which is arranged somewhat above the center of the opening of the vessel at an increased flow pressure so as to completely clean the interior thereof, wherein the flow pressure is higher than the flow pressure of the rotary nozzle in step (3), and wherein the cleaning water is completely removed through the syphon in the lower conical portion of the rinsing chamber;

(5) opening the sliding door upwardly with the concurrent rotation of the fastening support in the rotary means in the reversed direction of rotation relative to the rotation effected in step (2), and removing the empty cleaned vessel;

(6) repeating process steps (1) through (5) for the periodic and automatic emptying and cleaning of hygienic vessels; and (7) controlling the sequence of the process steps through a programmed control and motorized drive for the operating sequences in the process steps.

2. A process for effecting the automatic emptying and cleaning of hygienic vessels with an optimum infeed of rinsing water at minimum water use; comprising the following process steps:

(1) inserting filled, partially-emptied hygienic vessels into an insert basket;

(2) closing a cover of the insert basket and concurrently introducing nozzles arranged at the lower side of the cover into the middle point of the mouth opening of each of the vessels;

(3) inserting the insert basket into a rinsing chamber through insert rails provided on both sides of the basket into two holding retainers of an exchangeable rotary support interiorly of the rinsing chamber with the concurrent positioning of the cover of the insert basket above an arm arranged on the cover;

(4) closing from above a downwardly movable door on the front side of the rinsing chamber through pushbutton pressure with the concurrent sealing of the sealing chamber to the exterior and simultaneous emptying of the vessels, through motorized rotation of the rotary support, into a lower conical portion of the rinsing chamber in synchronism with the closing of the sliding door;

(5) rinsing the internal space of the rinsing chamber with pressurized water through nozzles in a manner so that all internal surfaces of the rinsing chamber and all external surfaces of the vessels are practically completely moistened for a short period and are cleaned;

(6) cleaning the vessels through the insertion of nozzles of a water distributing conduit on the insert basket supplied through a flexible pressure hose which is connected through a coupling element with a water supply conduit on the rotary support, in lieu of the rotary nozzle, so that the cleaned vessels are positioned in position inverted about the nozzles, and the cleaning water can fully flow off through a syphon at the lower end of the rinsing chamber;

(7) opening the door upwardly with the concurrent rotation of the rotary support in a reverse direction, uncoupling the flexible pressure hose with the coupling member from the water connection, and withdrawing the insert basket with the empty cleaned vessels;

(8) repeating the process steps (1) through (7) for the continual emptying and cleaning of vessels; and (9) controlling the sequence of the process steps through a programmed control and motorized drive of the sequences of the process steps.

3. Process as claimed in claim 1, wherein in step (1), in lieu of the exchangeable rotary means, there is suspended an exchangeable non-rotatable insert basket, wherein in step (4) there is connected to the conduit at outer chamber wall of the rinsing chamber, in lieu of the rotary coupling, a nozzle for water infeed which injects the pressurized water into an open receiving funnel which is connected with the other flow conduit which includes one or more upwardly directed spray nozzles within a suspension for injection of the cleaning water into the hygienic vessels which have their openings facing downwardly for effecting complete internal cleaning, and then effectuating the remaining cleaning measures pursuant to the process steps (1) through (7).

4. Process as claimed in claim 3, comprising effecting disinfection in the rinsing chamber of the emptied, clean hygienic vessels and the internal space of the rinsing chamber by dynamically traversing hot steam to blow through the rinsing chamber through a separate spray nozzle, and concurrently through a conduit in a water container above the chamber, which is located above the water level in the container, effecting on the water surface a condensation of the steam through a closed space, wherein a residual quantity of the steam can escape through a vent opening in the cover in order to avoid excess pressure in the rinsing chamber, and thereafter effecting a reverse rinsing of the rinsing chamber with water from a water container above the spray nozzle of step (3) or by the nozzle of the rotating arrangement of step (4) for condensation of the residual steam in the rinsing chamber for cooling of the hygienic vessels, and removing water through the syphon in the lower conical portion of the rinsing chamber.

5. Process as claimed in claim 2, wherein the short term cleaning step (3) is effected in about 5 to about 30 seconds at a flow pressure of about 0.5 to 1.0 bar of the cleaning water.

6. Process as claimed in claim 2, wherein the cleaning with pressurized water in step (4) is effected in about 10 to 60 seconds at a flow pressure of about 1.5 to 2.5 bar, and the cleaning water in step (3) is at room temperature or, as mixed water, has a temperature of about 40° to 50° C., and the pressurized water in step (4) forming the mixed water has a temperature of about 40° to 50° C.

7. Process as claimed in claim 2, wherein saturated steam is used as the hot steam for disinfection at about 100° C. and above and in such a quantity per unit of time in that the main quantity on the pregiven surface of the water level of the container for the cleaning water is practically completely condensed, or only a residual quantity escapes through the vent opening in the cover.

8. Process as claimed in claim 2, wherein for minimizing the water use, the water quantity in step (3) consists of about 8 to 10 liters, in step (4) of about 8 to 15 liters and the water quantity which is used for disinfection consists of about 200 to 300 $cm^3$ for each cleaning cycle of the hygienic vessel.

9. Process as claimed in claim 2, wherein through selection of the nozzle shape in step (4) and a change in the distance of the nozzle opening to the bottom of the presently inserted hygienic vessel of different shapes through exchange of the rotational arrangement with the conduit for the infeed of the pressurized water, there is effected an optimum cleaning effect at minimum water use.

10. Process as claimed in claim 2, comprising the process steps of:

(1) horizontally inserting a plurality, of in particular three, urine flasks and, thereabove, bed pans into a rotary support which is rotatable and located in a rinsing chamber, such that the horizontal nozzles are inserted into the urine flasks into the centers of their mouth openings; elimination of steps (2) and (3); implementing steps (4) and (5);

(2) cleaning the urine flasks and bed pans through lower spray nozzles while concurrently cleaning the bed pans through the first-mentioned nozzle by means of pressurized water;

(3) implementing process steps (7) through (9).

11. Process as claimed in claim 2, including disinfecting the emptied and cleaned hygienic vessels and the flasks and the internal space of the rinsing chamber through a throughflow of hot water or heated steam which is condensed in a separate chamber.

12. Process as claimed in claim 2, wherein said vessels comprise urine flasks, secretion flasks and other types of flasks which are to be emptied and cleaned.

13. Process as claimed in claim 1, including effecting the disinfection of the emptied cleaned hygienic vessels and the internal space of the rinsing chamber by conducting warm water through a flow conduit into the upper water container and through a short exposed air distance and injected above the water level into the funnel-shaped widening of another flow conduit, said further conduit exiting from the water container and the warm water contained therein being downwardly conducted through a U-shaped conduit through a steam generator into the rinsing chamber above the conical portion thereof whereby any water losses are contained within the water container and the water formed in the U-shaped portion of the conduit prevents the return flow of the steam.

* * * * *